US006137973A

United States Patent [19]

Nishiuwatoko et al.

[11] Patent Number: 6,137,973

[45] Date of Patent: Oct. 24, 2000

[54] CLEANING APPARATUS AND PROCESS CARTRIDGE HAVING SUCH CLEANING APPARATUS

[75] Inventors: Tsutomu Nishiuwatoko, Kashiwa; Satoshi Kurihara, Toride; Teruhiko Sasaki, Toride; Toru Koizumi, Toride, all of Japan

[73] Assignee: Canon Kabushiki Kaisha, Tokyo, Japan

[21] Appl. No.: 09/200,866

[22] Filed: Nov. 27, 1998

[30] Foreign Application Priority Data

Nov. 28, 1997 [JP] Japan ..... 9-344374

[51] Int. Cl.[7] ..... G03G 21/16

[52] U.S. Cl. ..... 399/111; 399/350

[58] Field of Search ..... 399/350, 351, 399/123, 111

[56] References Cited

U.S. PATENT DOCUMENTS 5,470,635 11/1995 Shirai et al. ..... 428/131
5,708,922 1/1998 Azuma et al. ..... 399/111
5,768,658 6/1998 Watanabe et al. .
5,815,644 9/1998 Nishiuwatoko et al. .
5,870,654 2/1999 Sato et al. .
5,870,655 2/1999 Nishiuwatoko et al. .
5,893,006 4/1999 Kanno et al. .

*Primary Examiner*—Arthur T. Grimley
*Assistant Examiner*—Greg Moldafsky
*Attorney, Agent, or Firm*—Fitzpatrick, Cella, Harper & Scinto

[57] ABSTRACT

A cleaning apparatus includes a cleaning blade urged against an electrophotographic photosensitive member, and a cleaning frame to which the electrophotographic photosensitive member and a cleaning blade holding member and a dip sheet are attached, and wherein an area having a small gap is formed between an inner wall of the cleaning frame and the other end of the cleaning blade holding member opposite to one end to which the cleaning blade is attached.

24 Claims, 12 Drawing Sheets

CLEANING APPARATUS AND PROCESS CARTRIDGE HAVING SUCH CLEANING APPARATUS

BACKGROUND OF THE INVENTION

1. Field of the Invention

The present invention relates to an image forming apparatus for forming an image by using an electrophotographic system, and a process cartridge used in such an image forming apparatus.

The image forming apparatus may be, for example, an electrophotographic copying machine, an electrophotographic printer (for example, LED printer, laser beam printer or the like), an electrophotographic facsimile, an electrophotographic word processor or the like.

2. Related Background Art

In image forming apparatuses using an electrophotographic technique, a uniformly charged image bearing member (photosensitive drum) is selectively exposed to form a latent image on the image bearing member, the latent image is visualized by a developing agent (toner) as a toner image, and the toner image is transferred onto a recording medium. The transferred image is fixed to the recording medium. In this way, image recording is effected. After the transferring, residual toner remaining on the photosensitive drum is removed by a cleaning means, and, then, the photosensitive drum is uniformly charged by a charge means, thereby preparing for next image forming process.

In such image forming apparatuses, replenishment of developing agent and maintenance such as adjustment, cleaning and replacement of various process means (charge means, developing means, cleaning means and the like) are required. In order to facilitate the maintenance, there has been proposed a process cartridge in which the photosensitive drum, and at least one of a charge means, a developing means and a cleaning means are collectively housed in a cartridge frame.

As the cleaning means, a cleaning apparatus in which a cleaning blade, made of elastic material such as urethane rubber, is urged against a photosensitive drum to scrape residual toner (waste toner) from the photosensitive drum and the waste toner is collected into a cleaning frame has been put to practical use. In order to realize effective cleaning, it is required that the cleaning blade is surely held at a predetermined position to urge the cleaning blade against the surface of the photosensitive drum with uniform pressure. To this end, the elastic cleaning blade is attached to a cleaning blade holding member having high rigidity and the holding member is attached to the cleaning frame. As the cleaning blade holding member, a blade holding metal plate having high rigidity obtained by a bending technique has been widely used.

In order to prevent the waste toner scraped from the photosensitive drum from leaking out of the frame, an elastic dip sheet for closing a gap between the cleaning frame and the photosensitive drum is disposed at an upstream side of the cleaning blade in a rotational direction of the photosensitive drum. In order to pass the residual toner on the photosensitive drum through the dip sheet and to scrape the residual toner by the cleaning blade, it is required that the dip sheet is surely urged against the photosensitive drum with pressure, which does not scrape the residual toner.

As shown in FIG. 8 (showing a conventional example) and FIG. 9 (showing the present invention, but, conveniently used for explanation of the conventional example), since a cleaning frame 52 has a box shape one face (facing to a developing device 40) of which is opened, it is difficult to ensure torsional rigidity of the frame itself. Since a blade holding metal plate 51*b* is fastened to the cleaning frame 52 by small screws 55 at both ends thereof, torsional rigidity at both ends of a process cartridge is enhanced, but, torsional rigidity of a central portion of the process cartridge depends upon the torsional rigidity of the cleaning frame 52 itself, the torsional rigidity of the central portion is weak, with the result that a reduction in cost obtained by reducing a thickness of the cleaning frame 52 cannot be achieved.

Particularly, as is in the illustrated example, in the process cartridge 2 in which guide bosses (means for positioning and angle-determining the cartridge in a mounted condition) 52*e* are formed on both longitudinal ends of the cleaning frame 52 and a grip 52*f* is formed on a central portion of the cleaning frame 52, when the process cartridge 2 is mounted to an image forming apparatus 1 (refer to FIG. 1), as shown in FIGS. 10 and 11, the guide bosses 52*e* are fitted into guide grooves 1*a* formed in the image forming apparatus 1. Thus, since a force direction toward a direction shown by the arrow F in FIG. 11 acts on the grip 52*f* under the condition that the both ends of the cleaning frame 52 are fixed by the guide bosses 52*e*, torsional stress for separating a dip sheet 54 from a photosensitive drum 20 (in a direction shown by the arrow R) is generated on the central portion of the cleaning frame 52.

Consequently, if the torsional strength of the cleaning frame 52 is insufficient, as shown in FIG. 12A, a free end 54*a* of the dip sheet 54 is separated from the photosensitive drum 20, with the result that toner stored in the cleaning frame 52 may be flown out. Particularly when the dip sheet 54 is formed from material having poor expansion/contraction, since the deformation generated at an attachment surface 54*b* of the sheet cannot be absorbed, as shown in FIG. 12B, undulation is generated at the free end 54*a* to easily create gaps between the dip sheet and the photosensitive drum 20. In the past, in order to prevent flow-out of the toner, it has been required that the thickness of the cleaning frame 52 is increased or reinforcing ribs (not shown) are provided.

SUMMARY OF THE INVENTION

An object of the present invention is to provide a process cartridge and a cleaning apparatus which have a cleaning means capable of ensuring torsional rigidity at a longitudinal central portion without depending upon the rigidity of a cleaning frame, thereby permitting reduction in cost by reducing the thickness of the cleaning frame and/or by simplifying a configuration of the cleaning frame.

For achieving the above purpose, a cleaning apparatus comprises a cleaning blade urged against an electrophotographic photosensitive member, a cleaning blade holding member having one end to which the cleaning blade is attached, a dip sheet member for collecting the toner removed by the cleaning blade and a cleaning frame to which the electrophotographic photosensitive member, the cleaning blade holding member and the dip sheet member are attached. An area having a small gap is formed between an inner wall of the cleaning frame and the other end of the cleaning blade holding member opposite to one end to which the cleaning blade is attached.

Also a process cartridge which can detachably be mounted to a main body of an image forming apparatus, comprises an electrophotographic photosensitive member, a cleaning means for removing a residual toner remaining on the electrophotographic photosensitive member and a cleaning frame for supporting the electrophotographic photosensitive member and the cleaning means. The cleaning means includes a cleaning blade abutting against the electrophotographic photosensitive member, a cleaning blade holding member having one end to which the cleaning blade is attached, and a sheet-shaped dip sheet member for collecting the toner removed by the cleaning blade and a small gap is formed between the other end of the cleaning blade holding member and an inner wall of the cleaning frame.

DESCRIPTION OF THE PREFERRED EMBODIMENTS

[First Embodiment]

A first embodiment of the present invention will now be explained with reference to FIGS. 1 and 2.

Figure 1:
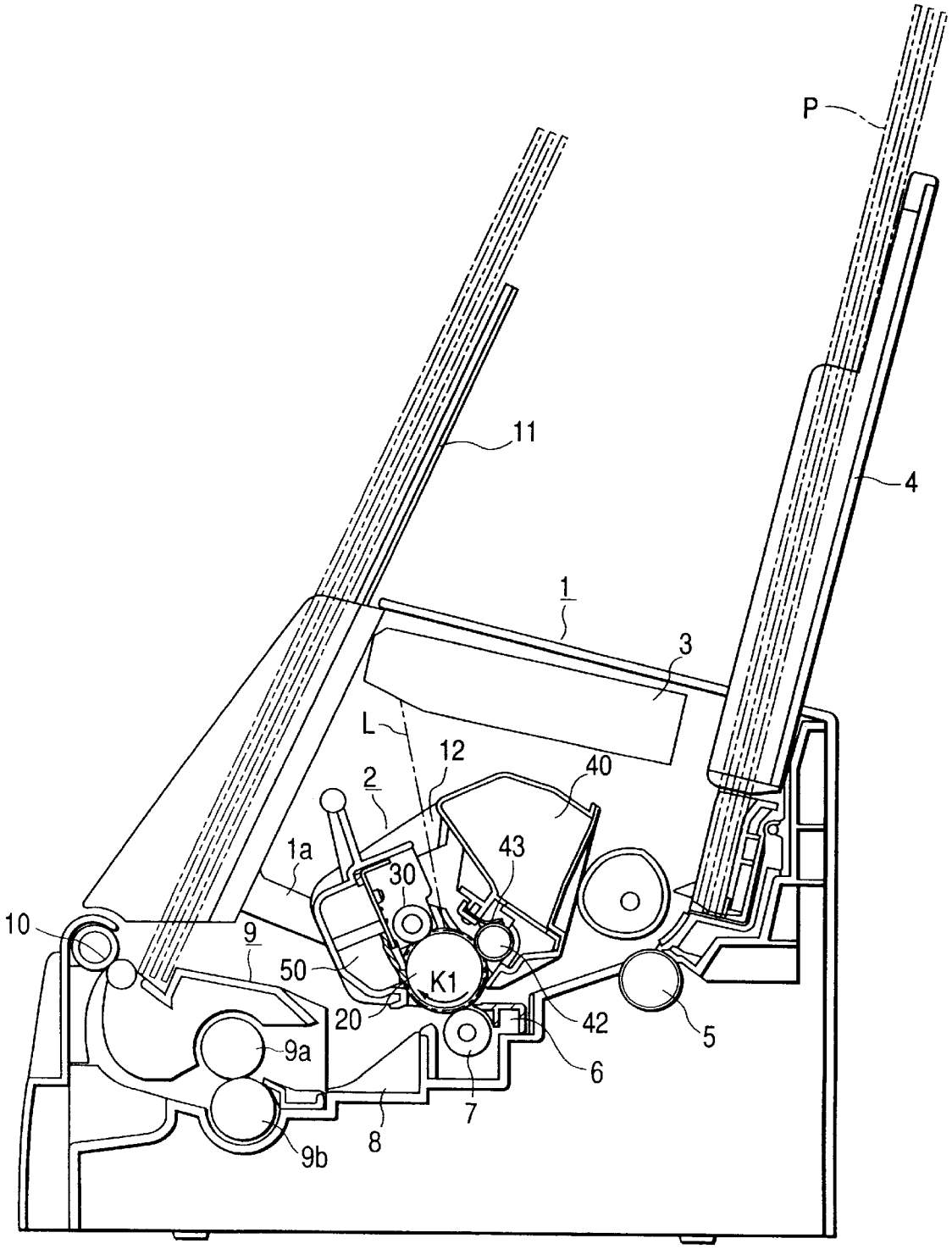
FIG. 1 is an elevational sectional view of an image forming apparatus according to a first embodiment of the present invention.

An image forming apparatus 1 according to the present invention shown in FIG. 1 is an electrophotographic laser beam printer to which a process cartridge 2 is mounted.

Above the process cartridge 2 mounted to the image forming apparatus 1, there is disposed a laser scanner unit 3 forming a main part of an exposure device, and a sheet tray 4 containing sheets materials P (on which images are to be formed) is disposed at a rear side (right side in FIG. 1) of the process cartridge 2. Further, within the image forming apparatus 1, along a sheet conveying direction, there are disposed a sheet supply roller 5, a transfer guide 6, a transfer charge roller 7, a convey guide 8, a fixing device 9, a discharge roller 10 and a discharge tray 11.

Figure 2:
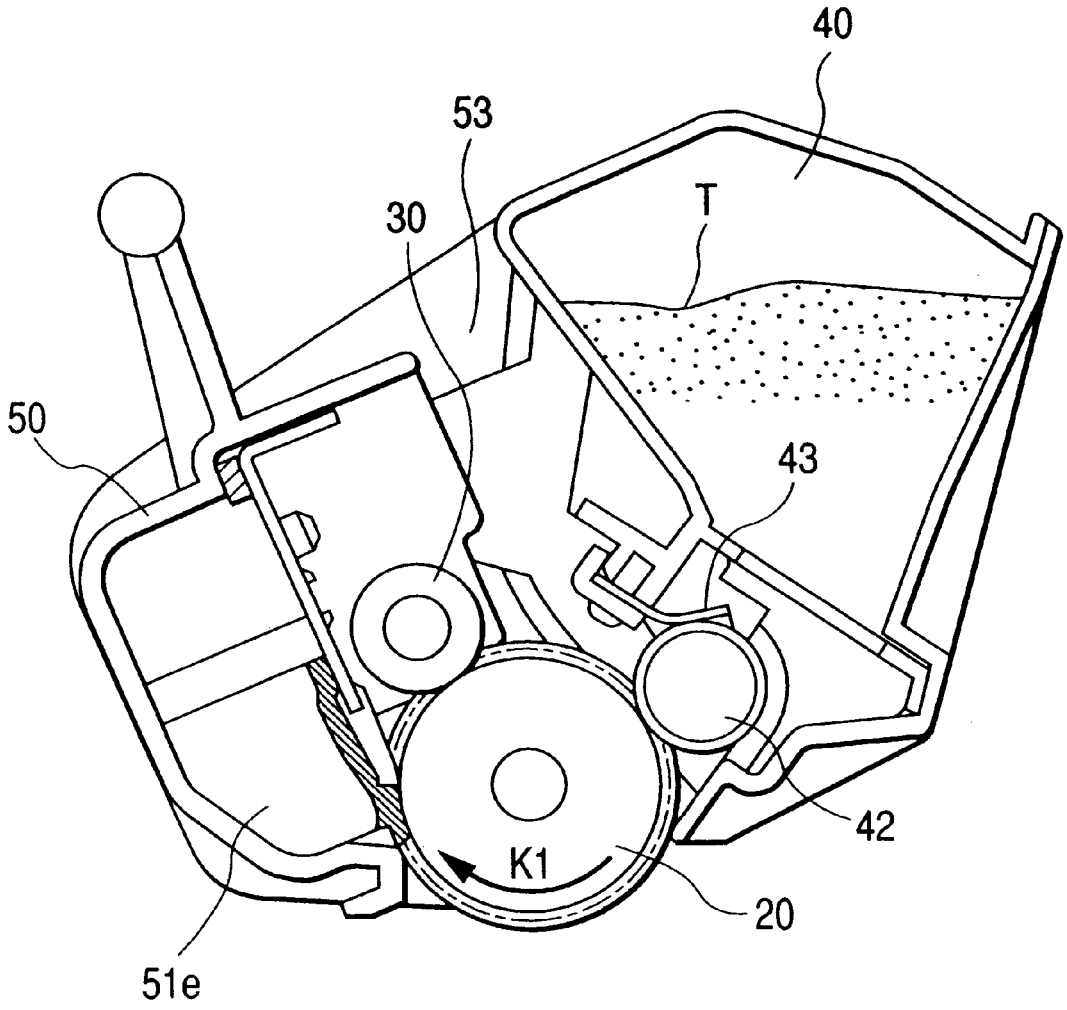
FIG. 2 is an elevational sectional view of a process cartridge according to the first embodiment.

As shown in FIG. 2, in the process cartridge 2, four process devices (rotatable photosensitive drum (image bearing member) 20, charge device 30, developing device 40 and cleaning apparatus 50) are housed in a cartridge frame.

Incidentally, the process cartridge may incorporate therein an electrophotographic photosensitive member and a cleaning means, and a charge means or a developing means as a cartridge unit, which can detachably be mounted to an image forming apparatus, or may incorporate therein an electrophotographic photosensitive member and a cleaning means, and at least one of a charge means and a developing means as a cartridge unit which can detachably be mounted to an image forming apparatus, or may incorporate therein at least an electrophotographic photosensitive member and a cleaning means as a cartridge unit which can detachably be mounted to an image forming apparatus.

Next, image formation will be briefly described. In response to a print start signal, the photosensitive drum 20 is rotated at a predetermined peripheral speed (process speed) in a direction shown by the arrow K1. The charge device 30 to which bias voltage is applied contacts a peripheral surface of the photosensitive drum 20, so that the peripheral surface of the photosensitive drum 20 is uniformly charged by the charge device 30.

The laser scanner unit 3 emits a laser beam L modulated in correspondence to a time-lapse electric digital pixel signal corresponding to target image information, which laser beam is in turn incident on the interior of the cartridge through an exposure window 12 formed in an upper surface of the cartridge, thereby scanning the peripheral surface of the photosensitive drum 20. As a result, an electrostatic latent image corresponding to the target image information is formed on the peripheral surface of the photosensitive drum 20. The electrostatic latent image is developed by a developing agent (toner) T coated on a developing agent bearing member (developing sleeve) 42 while regulating the thickness of a toner layer by means of a developing agent regulating member (developing blade) 43 of the developing device 40, as a toner image.

On the other hand, in synchronism with the laser output timing, the sheet material P is supplied from the sheet tray 4 by the sheet supply roller 5, and the supplied sheet material is supplied, through the transfer guide 6, to a transfer position between the photosensitive drum 20 and the transfer charge roller 7. Then, the toner image on the photosensitive drum 20 is transferred onto the sheet material P.

The sheet material P to which the toner image was transferred is separated from the photosensitive drum 20, and the separated sheet material is conveyed, along the convey guide 8, to the fixing device 9, where, while the sheet material is being passed through a nip between a fixing roller 9*a* and a pressure roller 9*b*, the toner image is fixed to the sheet material. Thereafter, the sheet material is discharged onto the discharge tray 11 by the discharge roller 10. After the transferring, residual toner remaining on the photosensitive drum is removed by the cleaning apparatus 50 for preparing for next image formation starting from the charging.

Next, the cleaning apparatus 50 according to the illustrated embodiment will be explained with reference to FIG. 3.

The cleaning apparatus 50 mainly includes a cleaning member 51 obtained by integrally attaching a cleaning blade 51*a* made of urethane and the like to a blade holding metal plate (cleaning blade holding member) 51*b*, a cleaning frame 52, and a dip sheet 54. The cleaning frame 52 has a box shape opened toward the developing device 40 and also acts as a waste toner reservoir 51*c*.

Figure 9:
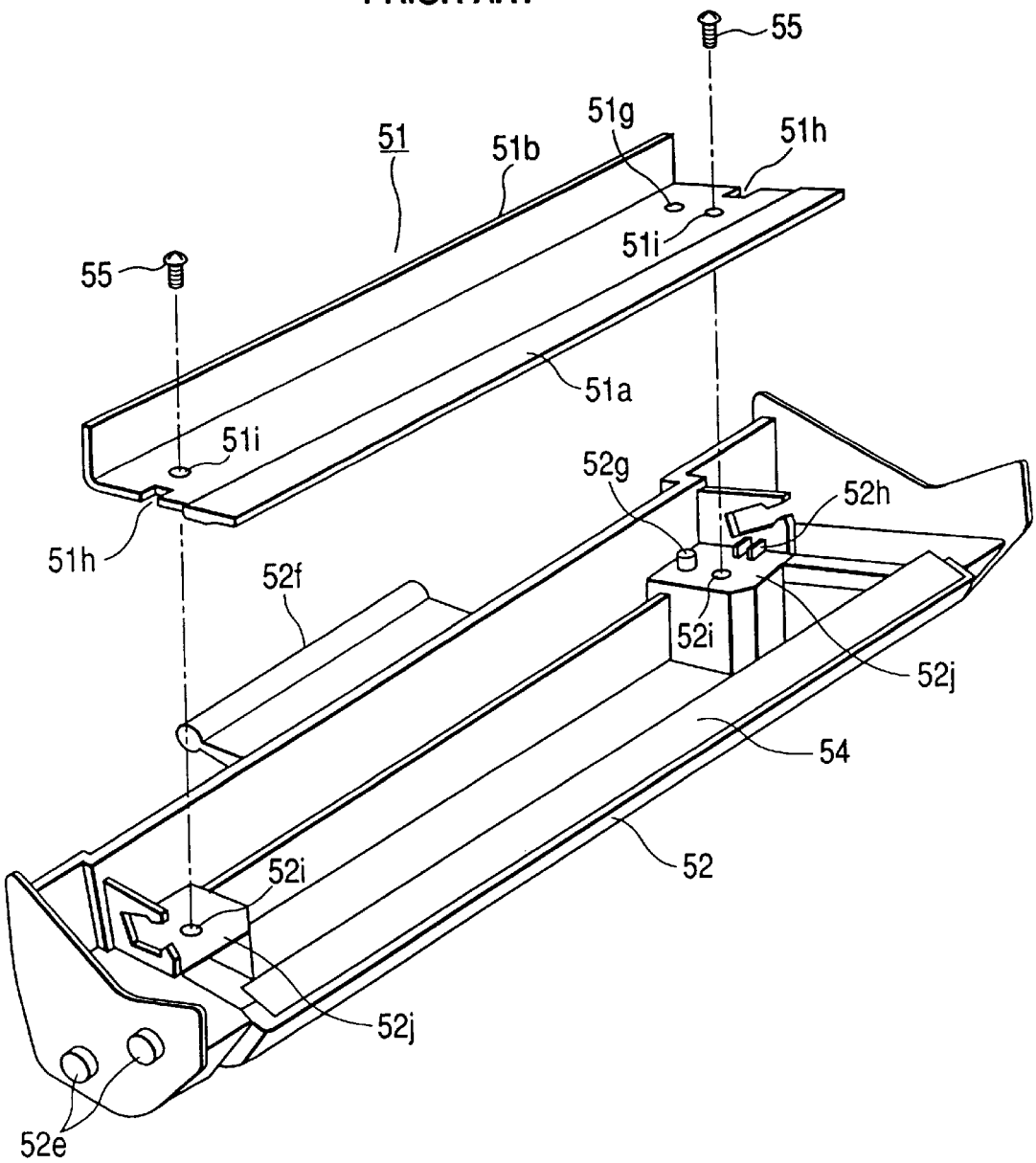
FIG. 9 PRIOR ART
FIG. 9 is a perspective view of a cleaning apparatus.
Figure 10:
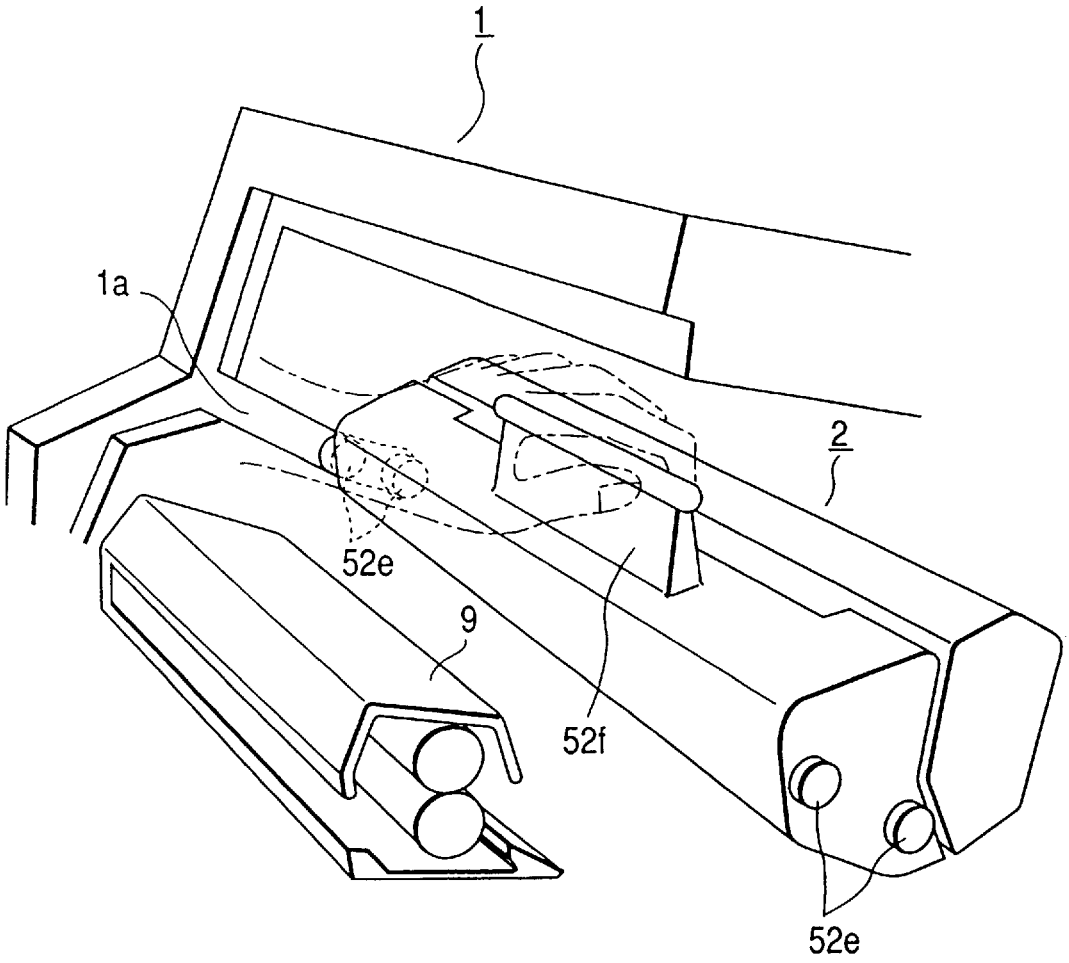
FIG. 10 PRIOR ART
FIG. 10 is a perspective view showing the mounting of a process cartridge.
Figure 11:
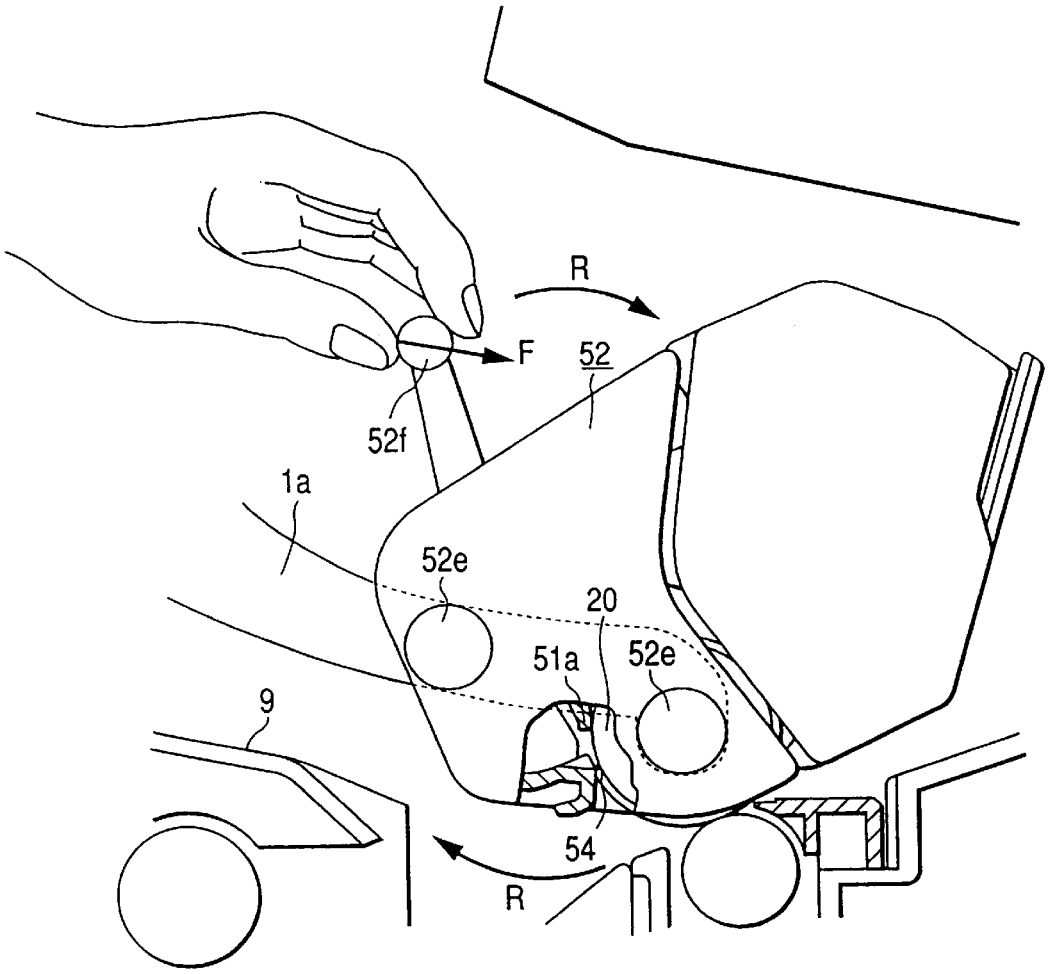
FIG. 11 PRIOR ART
FIG. 11 is a side view showing the mounting of the process cartridge.
Figure 12A:
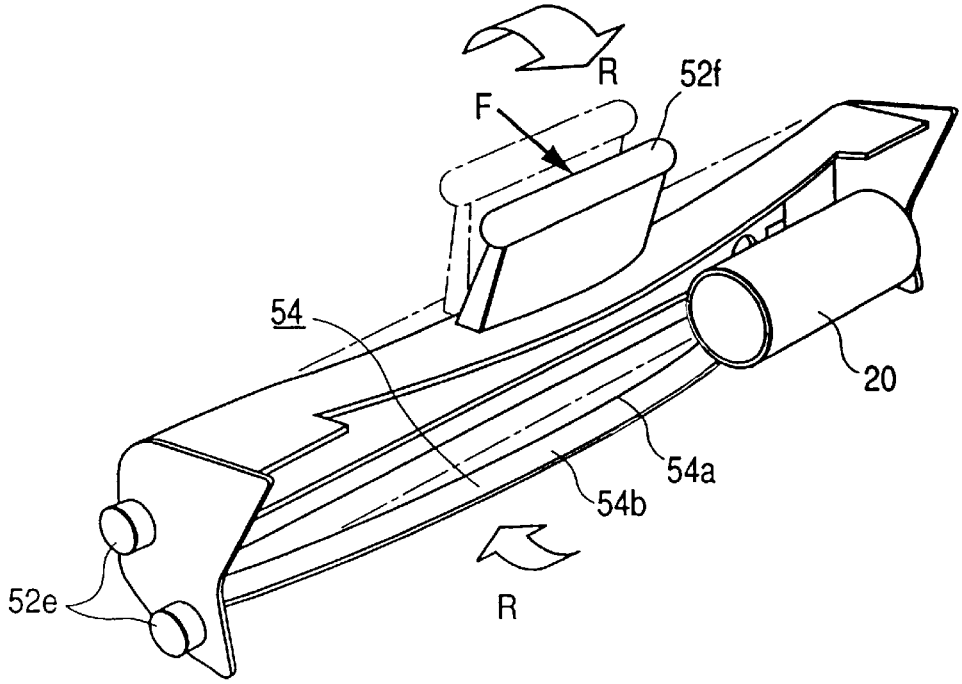
FIG. 12A PRIOR ART
FIGS. 12A and 12B are perspective views showing the conception of flexion of a cleaning frame in a conventional example.
Figure 12B:
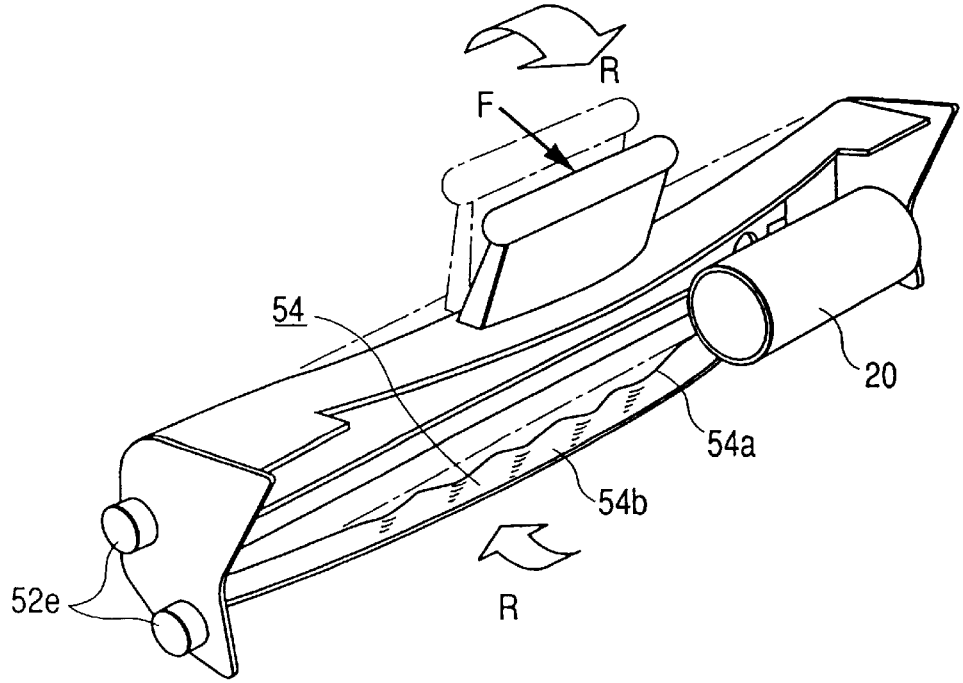
FIG. 12B PRIOR ART

Guide bosses 52*e* (refer to FIG. 9) are formed on both longitudinal end faces of the cleaning frame 52, and a grip 52*f* is formed on a longitudinal central portion of the cleaning frame. The guide bosses 52*e* are adapted to be fitted into guide grooves 1*a* (FIG. 11) provided in the image forming apparatus 1 and serve to determine an angle of the process cartridge 2 when the process cartridge is mounted and dismounted and to determine an angle and a position of the process cartridge 2 when the process cartridge was mounted.

In the cleaning member 51, the blade holding metal plate 51*b* is fastened to the cleaning frame 52 by small screws 55 at both longitudinal ends thereof (refer to FIG. 9), and an elastic seal 53 is positioned between the blade holding metal plate 51*b* and the cleaning frame 52 along its entire length. On the other hand, the elastic dip sheet 54 is disposed at an upstream side of an abutment portion between the cleaning blade 51*a* and the photosensitive drum 20 in a rotational direction of the photosensitive drum 20. The dip sheet 54 has a longitudinal dimension substantially equal to that of the cleaning blade 51*a* and is attached to the cleaning frame 52 in such a manner that a free end of the dip sheet is urged against the photosensitive drum 20.

A gap g (FIG. 3) between an inner wall 52*a* of the cleaning frame 52 and a flat bent portion 51*c* (substantially parallel with and opposed to the inner surface 52*a*) of the L-shaped blade holding metal plate 51*b* is selected to be 0.2 to 1.0 mm (preferably, 0.5 mm or less). As the result, if torsional moment R acts on the central portion of the cleaning frame 52, the inner wall 52*a* and the bent portion 51*c* contact each other within a range that does not create any gap between the tip end of the dip sheet 54 and the peripheral surface of the photosensitive drum 20.

Figure 4:
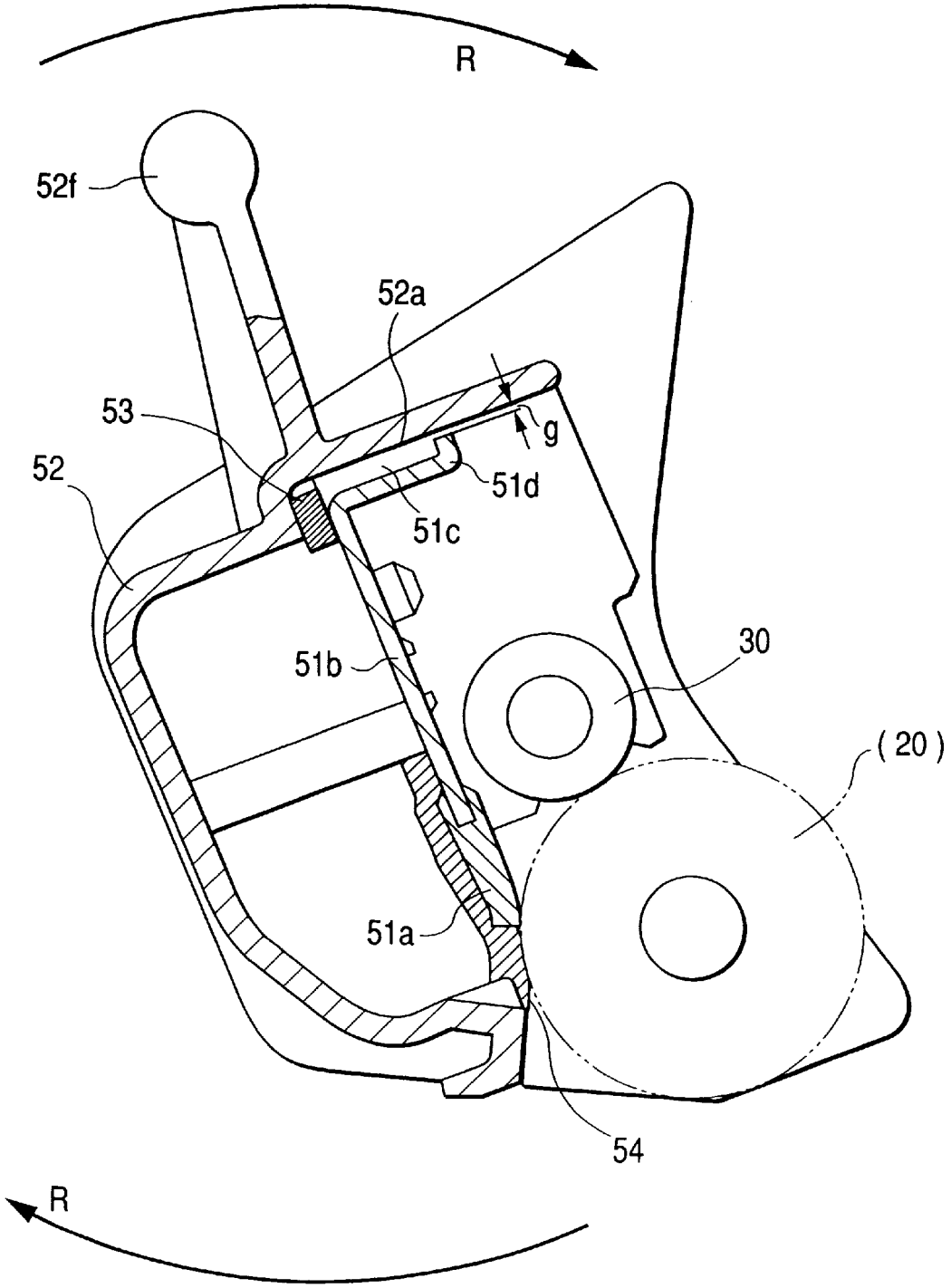
FIG. 4 is an elevational sectional view of a cleaning apparatus according to another aspect of the first embodiment.
Figure 5:
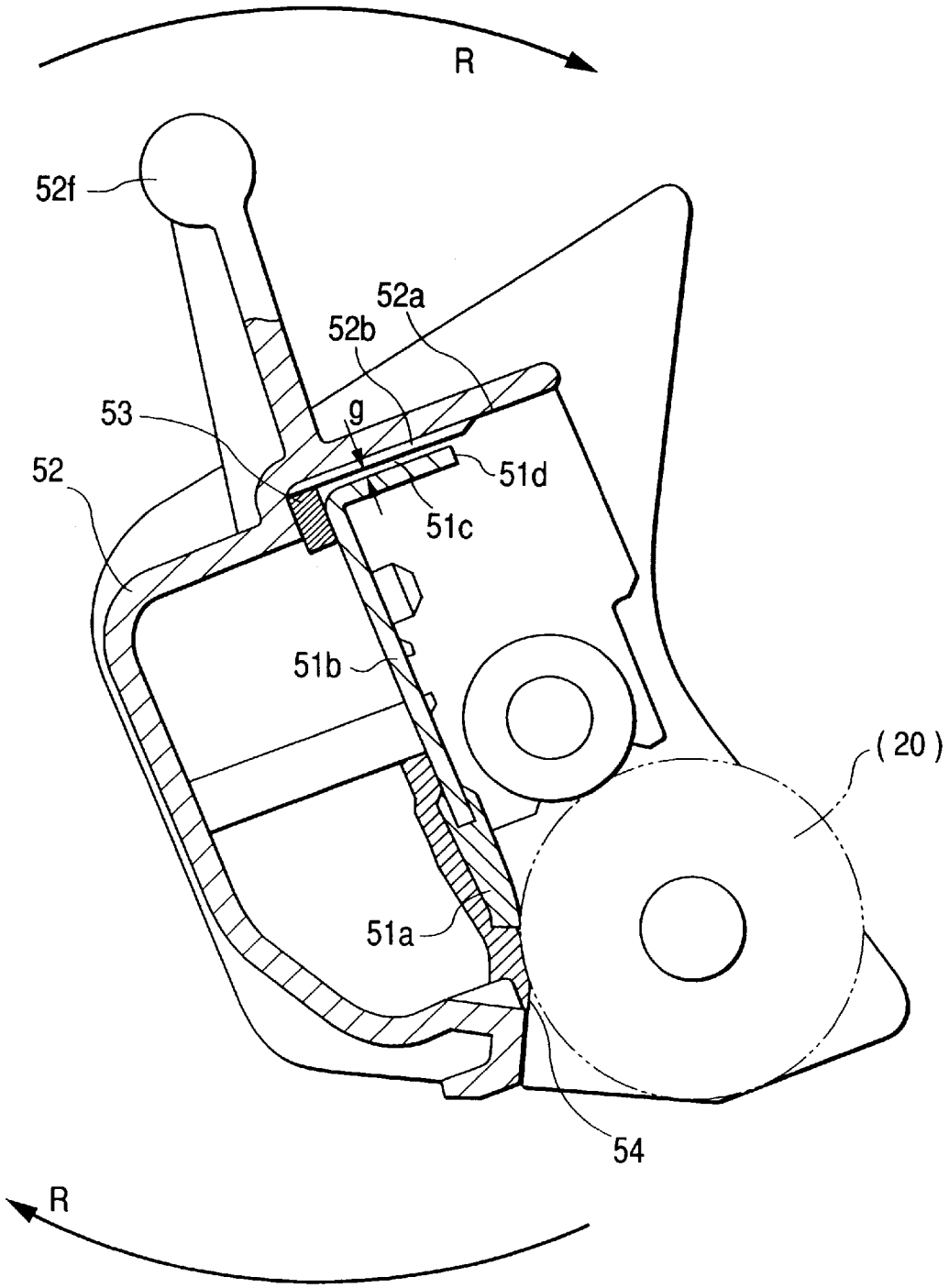
FIG. 5 is an elevational sectional view of a cleaning apparatus according to an alteration.

In the first embodiment, while an example that the gap g between the inner surface 52*a* and the bent portion 51*c* is selected to be 0.5 mm along the entire area was explained, so long as the gap g in an area near an end face 51*d* of the bent portion 51*c* is selected to be 0.5 mm, a tip end portion of the bent portion 51*c* may be bent toward the inner wall 52*a* as shown in FIG. 4, or a rib-like projection 52*b* may be formed on the inner wall 52*a* as shown in FIG. 5.

Figure 3:
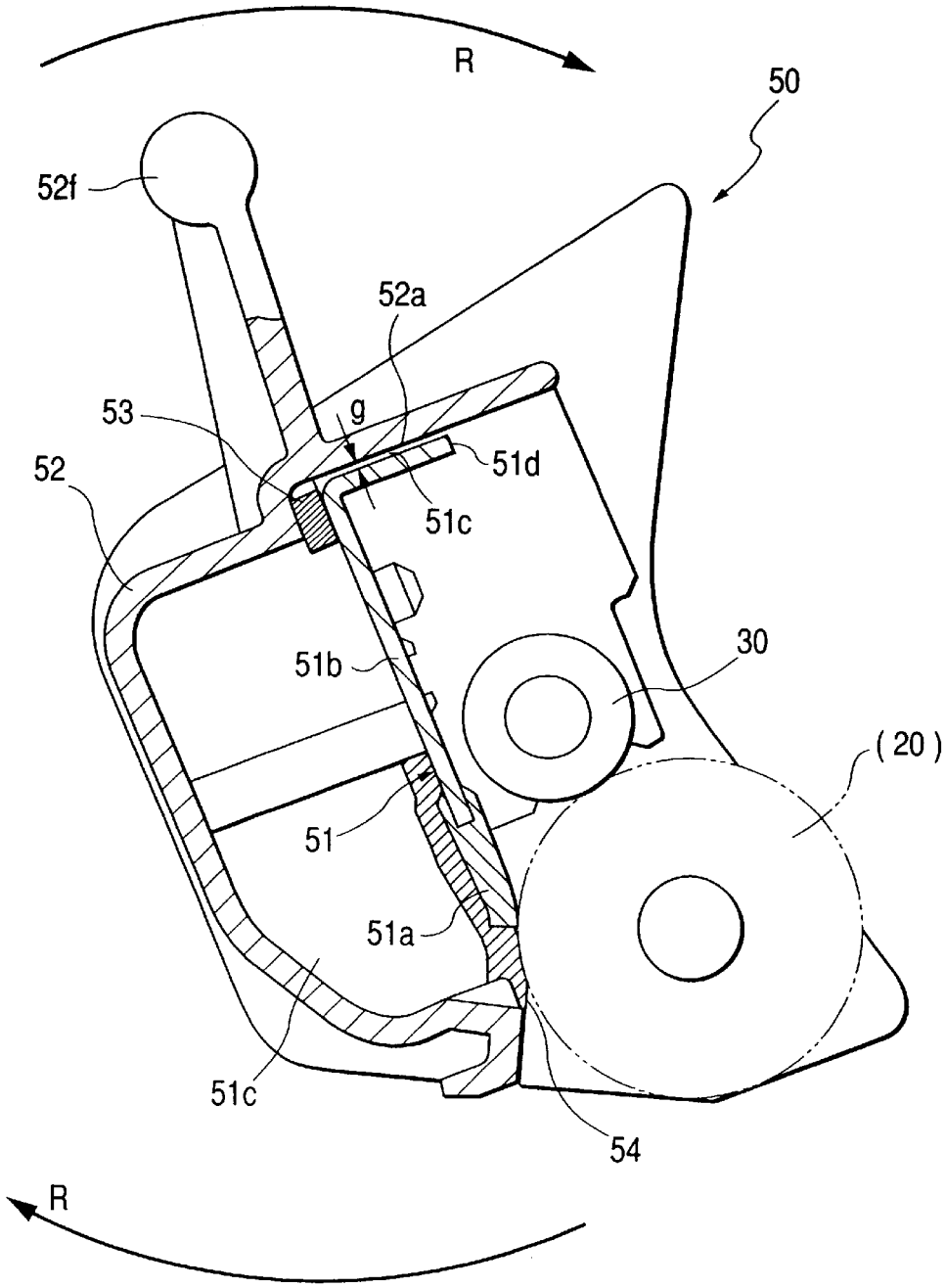
FIG. 3 is an elevational sectional view of a cleaning apparatus according to the first embodiment.

The gap g may be created in the entire image forming area as shown in FIGS. 3 and 4, or may be created at least at one position in the entire image forming area as shown in FIG. 5. When the gap g is created at one position, it is preferable that it is created at a central portion of the image forming area.

[Second Embodiment]

Figure 6:
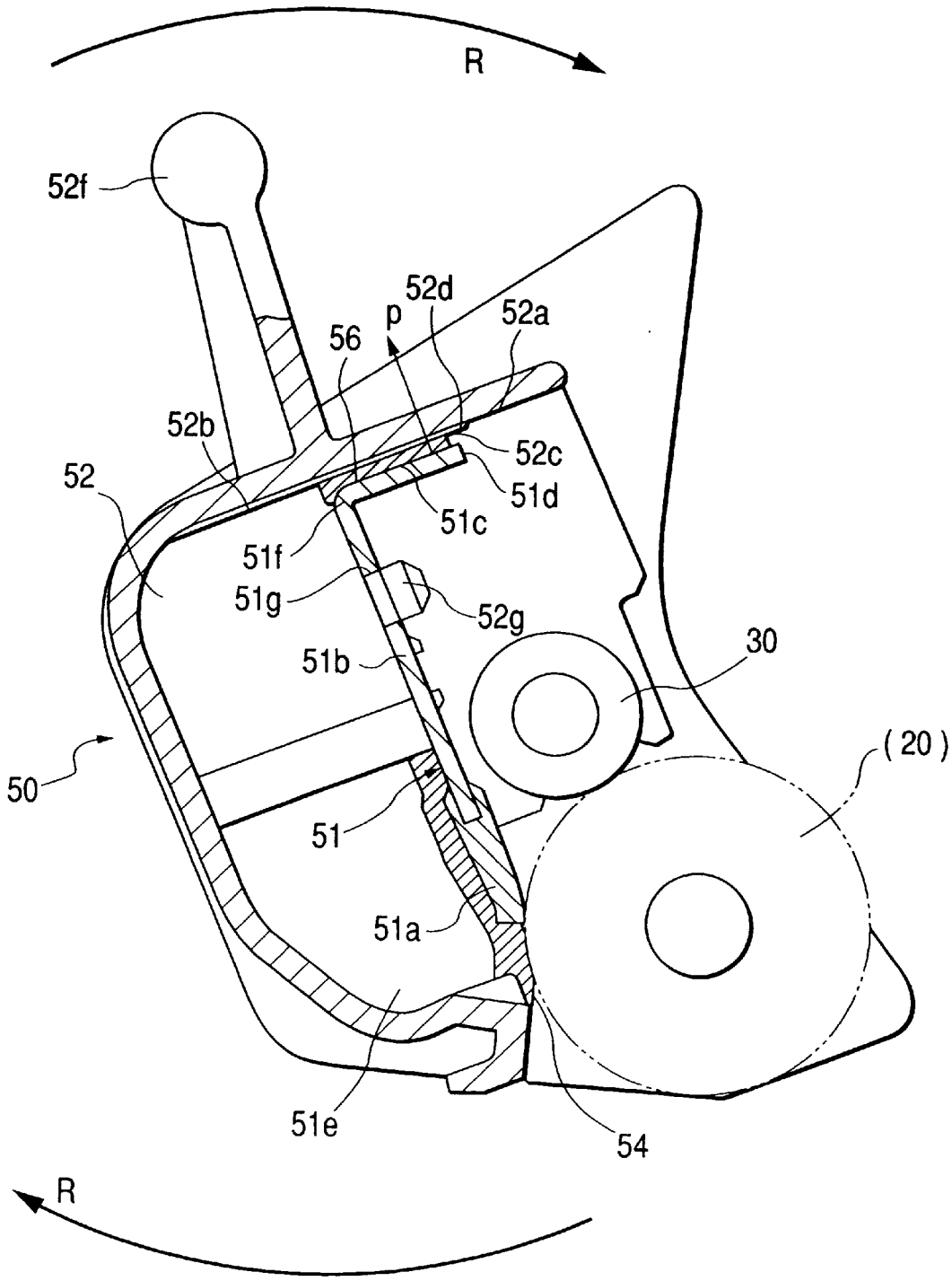
FIG. 6 is an elevational sectional view of a cleaning apparatus according to a second embodiment of the present invention.

Next, a cleaning apparatus 50 according to a second embodiment of the present invention will be explained with reference to FIGS. 6 and 7.

As is in the first embodiment, the cleaning apparatus 50 includes a cleaning member 51 obtained by integrally attaching a cleaning blade 51*a* made of urethane and the like to a blade holding metal plate 51*b*, a cleaning frame 52, an elastic seal 56 for sealing a waste toner reservoir 51*e*, and a dip sheet 54. In the cleaning member 51, the blade holding metal plate 51*b* is fastened to the cleaning frame 52 by small screws 55 at both longitudinal ends thereof, and the dip sheet 54 is attached to the cleaning frame 52 in such a manner that a free end (tip end) of the dip sheet is urged against the photosensitive drum 20.

In this second embodiment, the cleaning frame 52 integrally has a holding means for holding the charge device 30, which holding means is disposed at a downstream side of the cleaning member 51. The elastic seal 56 is formed from foamed urethane material having a thickness of 2.5 mm and a width extending from a bent corner portion 51*f* of the blade holding metal plate 51*b* to the vicinity of the end face 51*d* of the bent portion and a length equal to the entire length of the blade holding metal plate 51*b*, and the elastic seal is positioned between an inner wall 52*a* of the cleaning frame 52 and the bent portion 51*c* of the blade holding metal plate 51*b*. The elastic seal 56 is pinched between the inner wall 52*a* and the bent portion 51*c* in a compressed condition.

Figure 7:
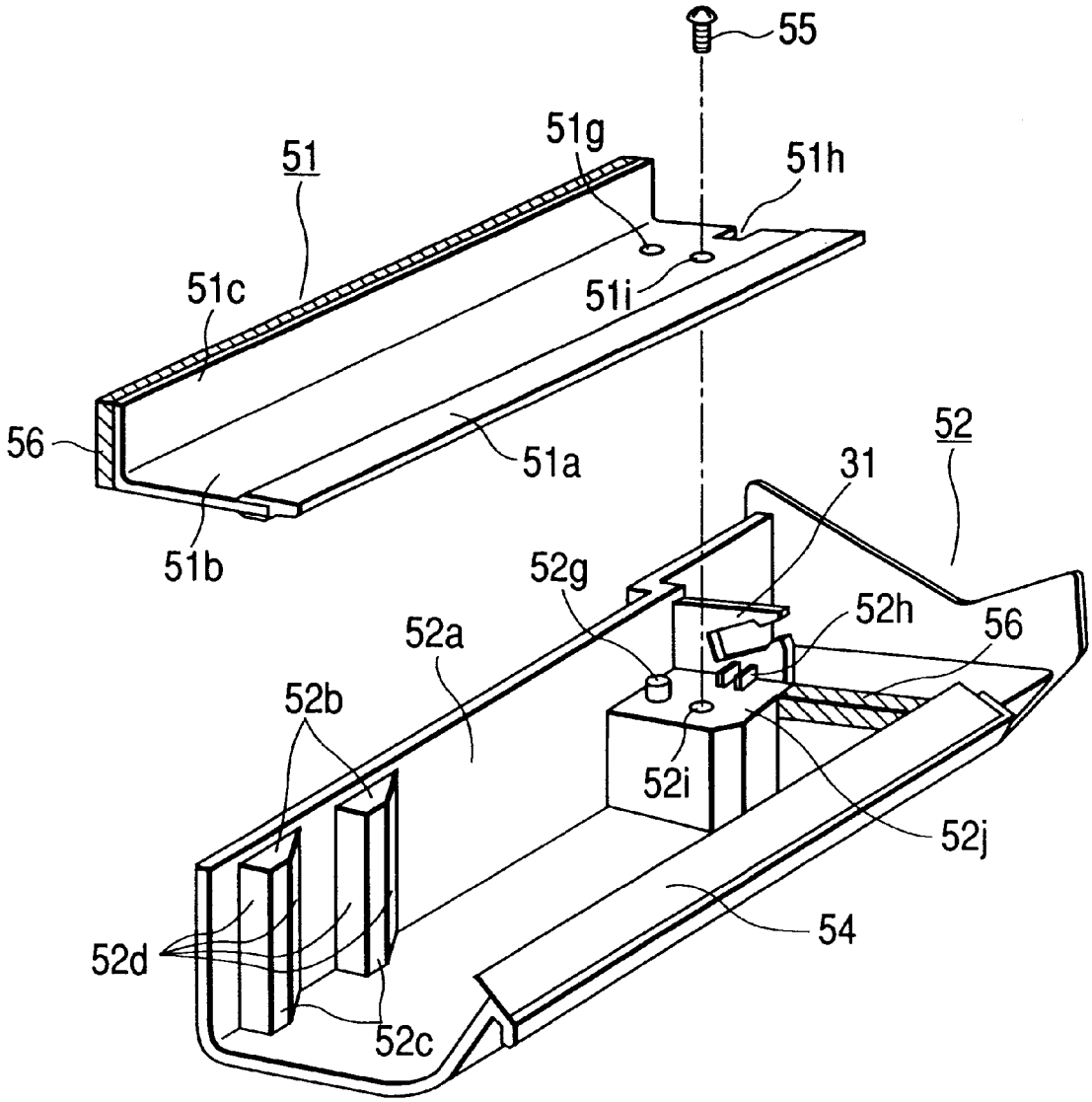
FIG. 7 is a perspective view of the cleaning apparatus according to the second embodiment.

In order to assemble the elastic seal 56, the elastic seal is adhered or welded to the bent portion 51*c* or the inner wall 52*a*, and the bent portion 51*c* of the cleaning blade holding metal plate 51*b* is urged toward the inner wall 52*a*, and a positioning hole 51*g* formed in one longitudinal end of the holding metal plate 51*b* is fitted onto a projection 52*g* formed on the cleaning frame 52 and notches 51*h* formed in both ends of the holding metal plate 51*b* are fitted onto projections 52*h* of the cleaning frame 52 (these projections are provided on both ends, but only one is shown in FIG. 7). Then, the small screws 55 are inserted into holes 51*i* of the blade holding metal plate 51*b* and threaded into female threaded holes 62*i* formed in seats 52*j* provided on longitudinal both sides of the cleaning frame 52, thereby urging the blade holding metal plate 51*b* against the seats 52*j*.

Figure 8:
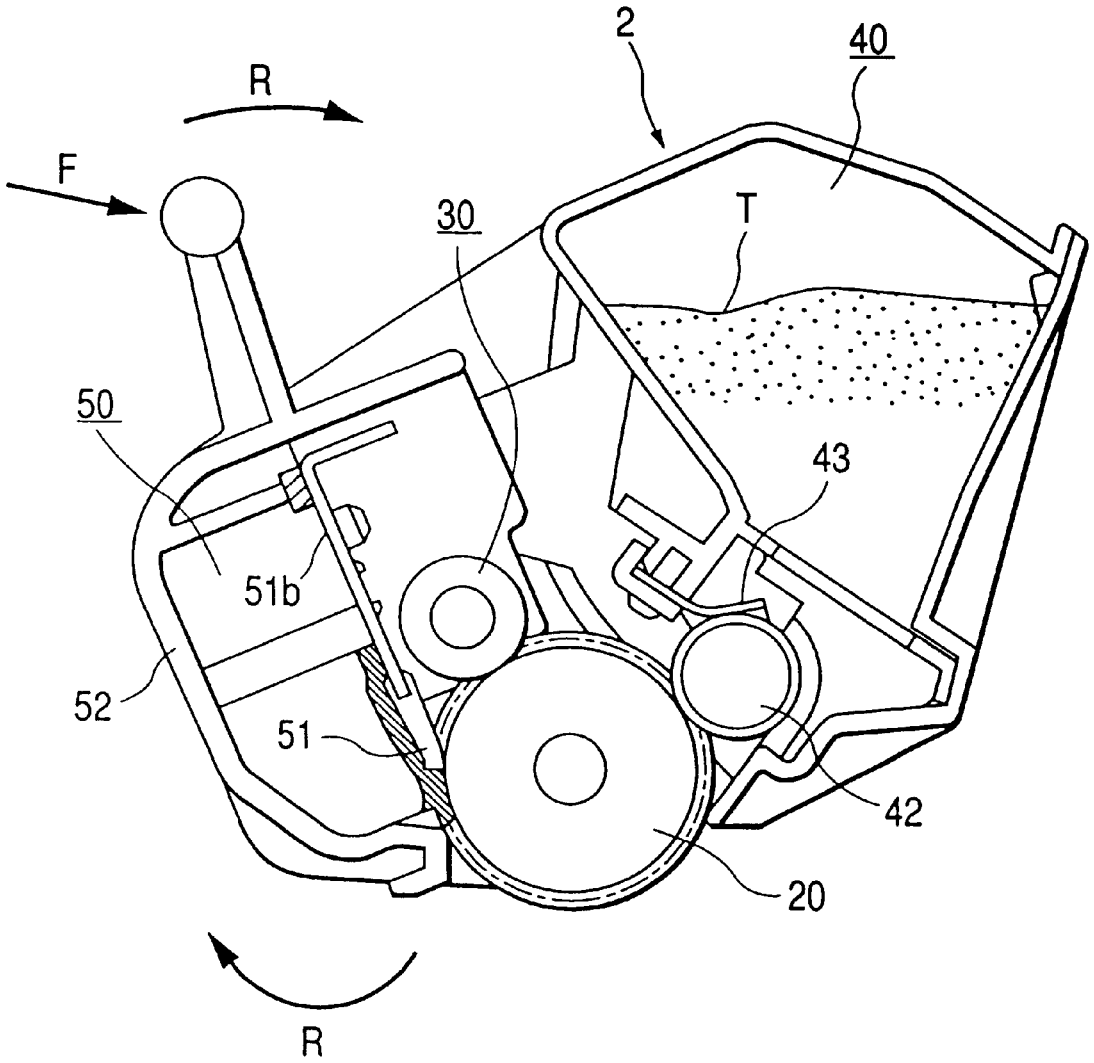
FIG. 8 PRIOR ART
FIG. 8 is an elevational sectional view of a conventional cleaning apparatus.

As shown in FIG. 7, rib-like projections 52*b* are formed on the inner wall 52*a* of the cleaning frame 52, and gaps between top surfaces 52*c* of the rib-like projections 52*b* and the bent portion 51*c* of the blade holding metal plate 51*b* are selected to be 0.5 to 1.5 mm (preferably, about 1.0 mm). With this arrangement, even if torsional moment R acts on the central portion of the cleaning frame 52, since a repelling force P of the elastic seal 56, compressed in the gaps between the rib-like projections 52*b* and the bent portion 51*c*, acts in a counter direction to the torsional moment R, the abutment between the dip sheet 54 and the photosensitive drum 20 is maintained (refer to FIG. 8).

In this embodiment, the elastic seal 56 for sealing the waste toner reservoir can enhance the rigidity of the cleaning frame resisting the torsion.

Incidentally, as shown in FIG. 7, side surfaces 52*d* of the rib-like projections 52*b* are preferably inclined to closely contact the elastic seal 56.

A plurality of rib-like projections 52*b* may be formed on the entire image forming area or at least one rib-like projection may be provided partially. When the single projection is provided, it is preferably positioned at the central portion of the image forming area.

As mentioned above, according to the present invention, in the cleaning apparatus having the cleaning member obtained by integrally attaching the cleaning blade to the blade holding member, the cleaning frame, and the dip sheet for closing the gap between the cleaning frame and the electrophotographic photosensitive member at the upstream side of the cleaning blade, the inner wall of the cleaning frame and the portion of the blade holding member (preferably, the bent portion of the blade holding member) are disposed adjacent to each other. As the result, if the moment tending to separate the sheet member from the electrophotographic photosensitive member acts on the central portion of the cleaning frame, the inner wall of the cleaning frame abuts against the blade holding member. With this arrangement, the abutment between the dip sheet and the electrophotographic photosensitive member is maintained to prevent flow-out of the toner.

Further, while an example that the gap between the inner wall of the cleaning frame and the blade holding member or the gap between the projection provided on the inner wall of the blade holding member is selected was explained, an elastic member may be arranged in the gap to achieve the same effect.

Incidentally, in the present invention, the image bearing member is not limited to the photosensitive drum but may be embodied as a photosensitive belt, and the developing device and the developing agent are also not limited to those in the illustrated embodiments. In addition, the kind of resin used in the cleaning frame of the cleaning apparatus is not limited to those in the illustrated embodiments.

What is claimed is:

1. A process cartridge which is detachably mountable to a main body of an image forming apparatus, comprising:

an electrophotographic photosensitive member;

cleaning means for removing a residual toner remaining on said electrophotographic photosensitive member; and a cleaning frame for supporting said electrophotographic photosensitive member and said cleaning means, wherein said cleaning means includes a cleaning blade abutting against said electrophotographic photosensitive member, a cleaning blade holding member having a first end to which said cleaning blade is attached, and a sheet-shaped dip sheet member for collecting the toner removed by said cleaning blade, and wherein a small gap is formed between a second end of said cleaning blade holding member and an inner wall of said cleaning frame, said small gap being so small that when said cleaning frame is deformed by an external force, said inner wall of said cleaning frame abuts against said second end of said cleaning blade holding member so that an abutment between said dip sheet member and said electrophotographic photosensitive member is maintained.

2. A process cartridge according to claim 1, wherein at least one of said small gap is formed in an area of said inner wall of said cleaning frame corresponding to an image forming area of said electrophotographic photosensitive member.

3. A process cartridge according to claim 1, wherein said cleaning blade holding member is provided at said second end with a bent portion and is provided at said first end with a flat portion for holding said cleaning blade, and said small gap is formed between said bent portion and said inner wall of said cleaning frame.

4. A process cartridge according to claim 3, wherein a projection is provided on said inner wall of said cleaning frame, and said small gap is formed between said projection and said bent portion of said cleaning blade holding member.

5. A process cartridge according to claim 3, wherein a tip end of said bent portion is bent toward said inner wall of said cleaning frame, and said small gap is formed between said tip end and said inner wall of said cleaning frame.

6. A process cartridge according to claim 1, wherein a grip is formed on a substantially longitudinal central portion of said cleaning frame.

7. A process cartridge according to any one of claims 1–6, wherein said small gap is selected to be 0.2 to 1.0 mm.

8. A process cartridge according to claim 7, wherein the process cartridge integrally incorporates therein charge means, developing means, said cleaning means and said electrophotographic photosensitive member as a unit which is detachably mountable to the main body of said image forming apparatus.

9. A process cartridge according to claim 7, wherein the process cartridge integrally incorporates therein said electrophotographic photosensitive member and at least one of charge means and developing means as a unit which is detachably mountable to the main body of said image forming apparatus.

10. A process cartridge according to any one of claims 1–6, wherein said small gap is selected to be 0.5 mm or less.

11. A process cartridge according to claim 10, wherein the process cartridge integrally incorporates therein charge means, developing means, said cleaning means and said electrophotographic photosensitive member as a unit which is detachably mountable to the main body of said image forming apparatus.

12. A process cartridge according to claim 10, wherein the process cartridge integrally incorporates therein said electrophotographic photosensitive member and at least one of charge means and developing means as a unit which is detachably mountable to the main body of said image forming apparatus.

13. A process cartridge which is detachably mountable to a main body of an image forming apparatus, comprising:

an electrophotographic photosensitive member;

cleaning means for removing a residual toner remaining on said electrophotographic photosensitive member; and a cleaning frame for supporting said electrophotographic photosensitive member and said cleaning means, wherein said cleaning means includes a cleaning blade abutting against said electrophotographic photosensitive member, a cleaning blade holding member having a first end to which said cleaning blade is attached, and a dip sheet member for collecting the toner removed by said cleaning blade, and wherein a small gap is formed between a second end of said cleaning blade holding member and an inner wall of said cleaning frame, said small gap being so small that when said cleaning frame is deformed by an external force, said inner wall of said cleaning frame abuts against said second end of said cleaning blade holding member so that an abutment between said dip sheet member and said electrophotographic photosensitive member is maintained, and wherein an elastic member is disposed in said gap in a compressed condition.

14. A process cartridge according to claim 13, wherein said elastic member is secured to said cleaning blade holding member or said cleaning frame.

15. A process cartridge according to claim 13, wherein said elastic member is adhered to said cleaning blade holding member and said cleaning frame.

16. A process cartridge according to claim 13, wherein a projection integral with said cleaning frame is provided on a portion of said inner wall of said cleaning frame which is contacted with said elastic member.

17. A process cartridge according to any one of claims 1–6 and 13–16, wherein the process cartridge integrally incorporates therein charge means, developing means, said cleaning means and said electrophotographic photosensitive member as a unit which is detachably mountable to the main body of said image forming apparatus.

18. A process cartridge according to any one of claims 1–6 and 13–16, wherein the process cartridge integrally incorporates therein said electrophotographic photosensitive member and at least one of charge means and developing means as a unit which is detachably mountable to the main body of said image forming apparatus.

19. A cleaning apparatus comprising:

a cleaning blade urged against an electrophotographic photosensitive member;

a cleaning blade holding member having a first end to which said cleaning blade is attached;

a dip sheet member for collecting toner removed by said cleaning blade; and a cleaning frame to which said electrophotographic photosensitive member, said cleaning blade holding member and said dip sheet member are attached;

wherein an area having a small gap is formed between an inner wall of said cleaning frame and a second end of said cleaning blade holding member, said small gap being so small that when said cleaning frame is deformed by an external force, said inner wall of said cleaning frame abuts against said second end of said cleaning blade holding member so that an abutment between said dip sheet member and said electrophotographic photosensitive member is maintained.

20. A cleaning apparatus according to claim 19, wherein a grip is formed on an outer surface of said cleaning frame.

21. A cleaning apparatus comprising:

a cleaning blade urged against an electrophotographic photosensitive member;

a cleaning blade holding member having a first end to which said cleaning blade is attached;

a dip sheet member for collecting toner removed by said cleaning blade; and a cleaning frame to which said electrophotographic photosensitive member, said cleaning blade holding member and said dip sheet member are attached;

wherein an elastic member is arranged in a compressed condition in a small gap between an inner wall of said cleaning frame and a second end of said cleaning blade holding member, said small gap being so small that when said cleaning frame is deformed by an external force, said inner wall of said cleaning frame abuts against said second end of said cleaning blade holding member so that an abutment between said dip sheet member and said electrophotographic photosensitive member is maintained.

22. A cleaning apparatus according to claim 21, wherein a grip is formed on an outer surface of said cleaning frame.

23. A cleaning apparatus according to any one of claims 19–22, wherein said small gap is selected to be 0.2 to 1.0 mm.

24. A cleaning apparatus according to any one of claims 19–22, wherein said small gap is selected to be 0.5 mm or less.

* * * * *

UNITED STATES PATENT AND TRADEMARK OFFICE

CERTIFICATE OF CORRECTION

PATENT NO. : 6,137,973

DATED : October 24, 2000

INVENTOR(S): TSUTOMU NISHIUWATOKO, ET AL.

It is certified that error appears in the above-identified patent and that said Letters Patent is hereby corrected as shown below:

ON THE COVER PAGE AT [57], IN THE ABSTRACT:
Line 4, "member" (1st occurrence) should read --member,--.

COLUMN 1:
Line 43, "frame" should read --frame that--.

COLUMN 2:
Line 48, "permitting" should read --permitting a--

Signed and Sealed this

First Day of May, 2001

*Attest:*

Nicholas P. Godici

NICHOLAS P. GODICI

*Attesting Officer*

*Acting Director of the United States Patent and Trademark Office*